US006176316B1

(12) United States Patent
Hart

(10) Patent No.: US 6,176,316 B1
(45) Date of Patent: Jan. 23, 2001

(54) SUBSEA WELL HEAD ASSEMBLY

(75) Inventor: Brian Hart, Wakefield (GB)

(73) Assignee: Cooper Cameron Corporation, Houston, TX (US)

( * ) Notice: Under 35 U.S.C. 154(b), the term of this patent shall be extended for 0 days.

(21) Appl. No.: 09/327,868

(22) Filed: Jun. 8, 1999

(30) Foreign Application Priority Data

Aug. 10, 1998 (EP) ..... 98306382

(51) Int. Cl.[7] ..... E21B 33/03
(52) U.S. Cl. ..... 166/368; 166/332.3
(58) Field of Search ..... 166/336, 368, 166/86.1, 97.1, 351, 366, 363, 332.1, 332.3

(56) References Cited

U.S. PATENT DOCUMENTS 3,078,921 2/1963 Edwards .
3,115,934 12/1963 Rector .
3,592,489 7/1971 Baugh et al. .
4,154,298 * 5/1979 Gano ..... 166/85.5
4,637,419 1/1987 Hughes .
4,637,470 1/1987 Weathers et al. .
4,681,133 * 7/1987 Weston ..... 137/315.18
4,732,215 * 3/1988 Hopper ..... 166/366
5,992,527 * 11/1999 Garnham et al. ..... 166/379
6,053,252 * 4/2000 Edwards ..... 166/348
6,109,352 * 8/2000 Edwards et al. ..... 166/336

* cited by examiner

*Primary Examiner*—Frank Tsay
(74) *Attorney, Agent, or Firm*—Jackie Lee Duke

(57) ABSTRACT

A subsea wellhead assembly is disclosed with an extension spool secured thereto and an in line tree assembly locked within the extension spool. Ball valves are disposed within the vertical bores of the in line tree assembly. Valve actuators are disposed radially on the extension spool with a cylindrical sleeve mounted coaxially around the one end of the actuator and rotatable relatively to the actuator about the common axis of the actuator and the sleeve, so that, when the actuator engages with the corresponding ball valve, the sleeve bridges the gap between the extension spool and the in line tree assembly to lock the in line tree assembly to the extension spool.

6 Claims, 2 Drawing Sheets

SUBSEA WELL HEAD ASSEMBLY

BACKGROUND OF THE INVENTION

1. Field of the Invention

The present invention relates to a subsea wellhead assembly, of the kind comprising a spool assembly having a vertical production through bore for receiving an insert comprising at least one valve element having a vertical bore coaxial with the vertical production through bore, and a valve actuator for rotating the or each valve element to control fluid flow through the insert, the actuator being fixed on the spool assembly and being advanceable, in use, radially of the coaxial bores into the valve insert so that one end mates with the valve element allowing operation of the valve element. Such a wellhead assembly will be referred to as the kind described.

2. Description of Related Art

Examples of such a wellhead assembly can be found in U.S. Pat. Nos. 3,078,921 and 3,115,934.

SUMMARY OF THE INVENTION

A disadvantage with such assemblies is that when the insert is locked into the spool assembly, stack up tolerances make it very difficult to guarantee that the alignment between the spool assembly and the insert is sufficiently accurate to allow the or each actuator to engage properly with a corresponding valve element.

According to the present invention, a wellhead assembly of the kind described is characterized by a cylindrical sleeve mounted coaxially around the one end of the actuator and rotatable relatively to the actuator about the common axis of the actuator and the sleeve, so that, when the actuator engages with the corresponding valve element, the sleeve bridges the gap between the spool assembly and insert so as to lock the insert to the spool assembly.

As the sleeve is mounted to the valve actuator as described, when the sleeve locks the valve insert in place, the valve actuator is guaranteed to be in exact alignment with the appropriate port in the insert and the actuator can be rotated to operate the valves.

BRIEF DESCRIPTION OF THE DRAWINGS

An example of a wellhead assembly constructed in accordance with the present invention will now be described with reference to the accompanying drawings, in which.

DESCRIPTION OF THE PRESENTLY PREFERRED EMBODIMENT

The wellhead comprises a wellhead housing 1 to which an extension spool 2 is fixed and sealed. Two hydraulically operated valve operating modules 3 are bolted to the extension spool 2 and will be described in greater detail below.

Figure 1:
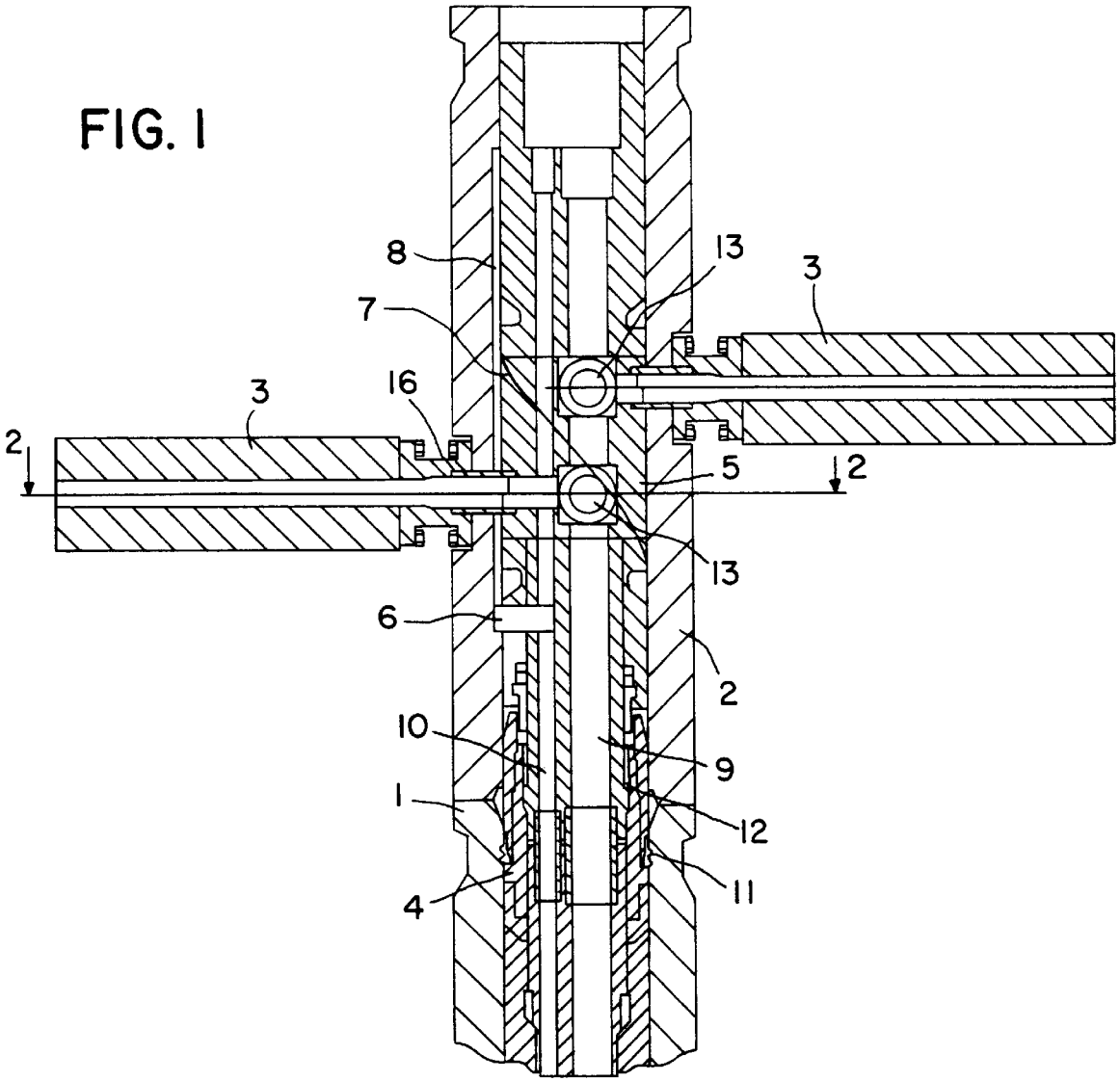
FIG. 1 is a schematic cross section of the wellhead assembly.

With these elements in place, a tubing hanger 4 with an in line tree assembly 5 attached is run into the wellhead and the tubing hanger 4 is landed within the wellhead housing 1. The arrangement as described above for, with the exception of the actuators, is similar to that shown in EP 0845577. A pin 6 is extended hydraulically from the in line tree assembly 5 and into the extension spool 2. The tubing hanger 4 and the in line tree assembly 5 are then picked up whereupon the pin 6 follows a helical profile 7 within the extension spool 2. Once the pin 6 reached the top of the helical groove 7, it is lowered down an axial groove 8 within the extension spool 2 to the position shown in FIG. 1. This approach ensures that the production bore 9 and annulus bore 10 are correctly aligned and gives a known datum for the position of the in line tree assembly.

Once in position, the tubing hanger 4 is locked to the wellhead I by a locking ring 11. A latch ring 12 is then operated to unlatch the in line tree assembly 5 from the tubing hanger 4.

Figure 2:
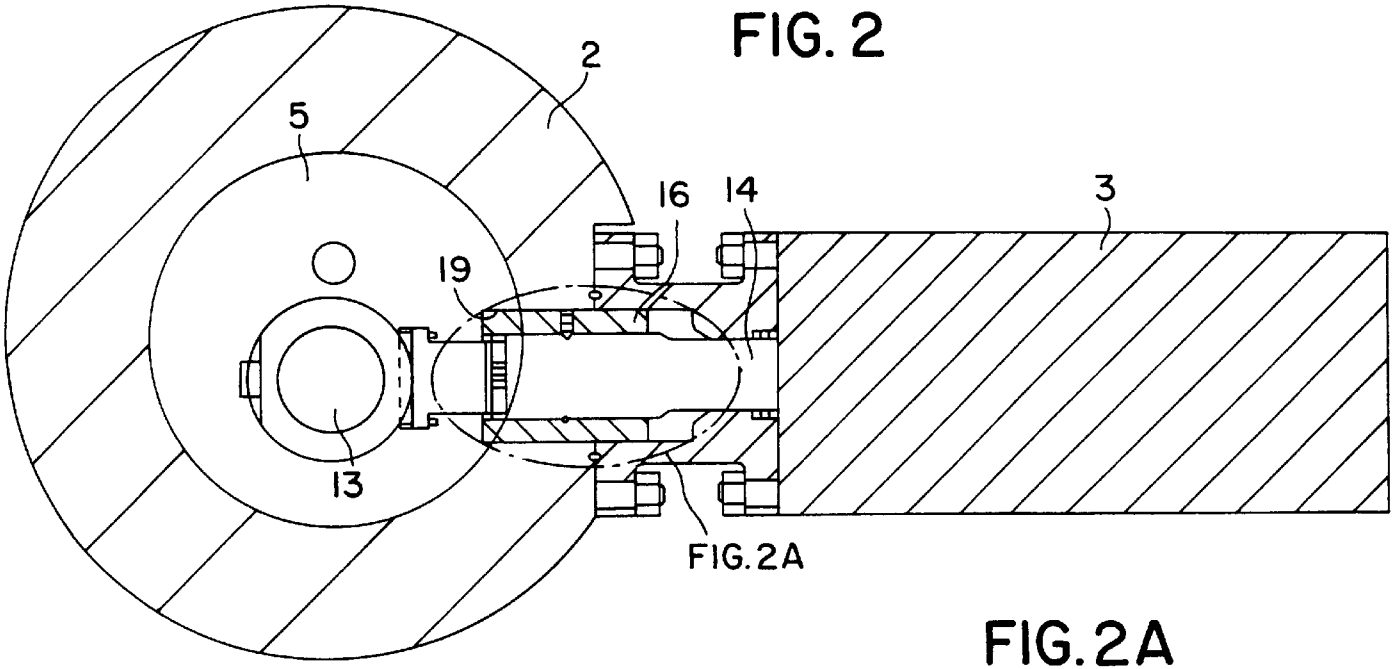
FIG. 2 is a cross section through line II—II in FIG. 1.

The in line tree assembly 5 is provided with two ball valves 13 which are rotated between various operating positions by the operating modules 3. As best seen in FIG. 2, each operator 3 has a linearly extendable and rotatable actuator stem 14 which is provided with a cut out key portion 15 (FIG. 2B) on one end which engages with a corresponding key portion (not shown) on the valve element 13.

Figure 2A:
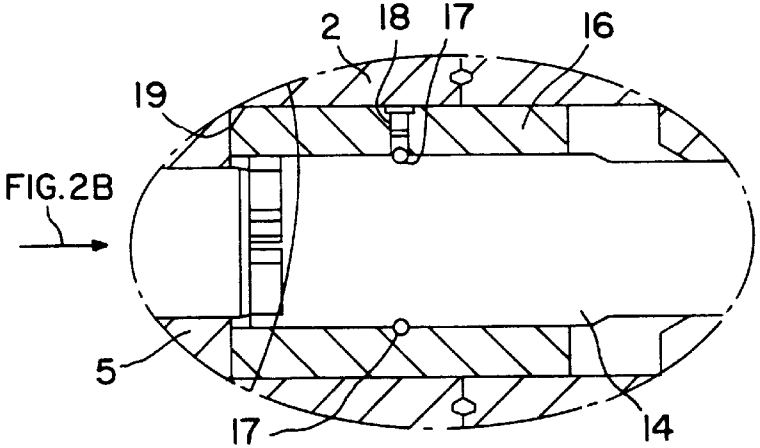
FIG. 2A shows the detail of the ringed portion as marked in FIG. 2.
Figure 2B:
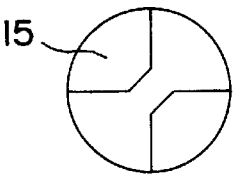
FIG. 2B is a view of the end portion of the actuator shown in FIG. 2A.

Referring to FIG. 2A, a cylindrical sleeve 16 is retained on the end of the actuator stem 14 on balls 17 inserted through a port 18 in the sleeve. The sleeve is rotatable about the actuator stem 14 but is axially fixed with respect to the actuator.

With the in line tree assembly 5 installed and unlatched as mentioned above, each actuator stem 14 and cylindrical sleeve 16 are advanced to bring the end of the actuator into engagement with the appropriate valve element 13. At the same time, each sleeve 16 fits into a countersunk bore 19 within the in line tree assembly 5, thereby locking the in line tree assembly in position within the extension spool 2. Because the locking mechanism is provided by the sleeve 16 which surrounds the actuator stem 14, the correct alignment of the actuator stem 14 with respect to the valve element 13 is always ensured.

What is claimed is:

1. A subsea wellhead assembly for use with an in line tree assembly, comprising:

a wellhead housing;

a tubing hanger secured within said wellhead housing, said tubing hanger having a plurality of vertical bores;

an extension spool secured in sealing engagement with said wellhead housing;

an in line tree assembly secured within said extension spool, said in line tree assembly having a plurality of vertical bores in sealing alignment with said plurality of vertical bores within said tubing hanger;

at least one of said plurality of vertical bores of said in line tree assembly including valving means for controlling fluid flow in said at least one of said plurality of vertical bores of said in line tree assembly;

a valve operating module secured to said extension spool and substantially aligned with said valving means, said valve operating module including a linearly extendable and rotatable actuator stem for actuating said valving means; and, a sleeve rotatably secured on said actuator stem, said sleeve engaging said in line tree assembly when said actuator stem is extended to lock said in line tree assembly in said extension spool.

2. A subsea wellhead assembly for use with an in line tree assembly according to claim 1 wherein:

said sleeve rotatably secured on said actuator stem is secured on said actuator stem by a plurality of balls positioned between said sleeve and said actuator stem.

3. A subsea wellhead assembly for use with an in line tree assembly according to claim 2 wherein:

said linearly extendable and rotatable actuator includes a key portion for engaging a corresponding key portion on said valving means to transmit rotation to said valving means.

4. A subsea wellhead assembly for use with an in line tree assembly according to claim 3 wherein:

said in line tree assembly includes a pin;

said extension spool includes a helical profile and an axial groove; and, said pin in said in line tree assembly sequentially engaging said profile groove and said axial groove in said extension spool to provide a known orientation of said plurality of vertical bores in said in line tree assembly and said plurality of vertical bores within said tubing hanger.

5. A subsea wellhead assembly for use with an in line tree assembly according to claim 4 wherein:

said valving means is a ball valve.

6. A subsea wellhead assembly for use with an in line tree assembly according to claim 4 wherein:

said valving means is a gate valve.

* * * * *